United States Patent [19]

Riso et al.

[11] 4,250,886

[45] Feb. 17, 1981

[54] ORTHOTIC

[76] Inventors: Rhea R. Riso, 240 Garth Rd., Apt. 2A2; Richard E. Memoli, 22 Carstensen Rd., both of Scarsdale, N.Y. 10583

[21] Appl. No.: 52,437

[22] Filed: Jun. 26, 1979

[51] Int. Cl.[3] ..... A61F 5/14

[52] U.S. Cl. ..... 128/621

[58] Field of Search ..... 128/621, 586, 614, 587, 128/615; 36/91, 92, 28, 25 R

[56] References Cited

U.S. PATENT DOCUMENTS

| | | | |
|---|---|---|---|
| 1,841,942 | 1/1932 | Fenton | 128/586 |
| 2,081,474 | 5/1937 | Burns | 128/615 |
| 2,083,581 | 6/1937 | Silver | 128/586 |
| 2,447,231 | 8/1948 | Bruckner | 128/586 |
| 2,641,066 | 6/1953 | Filardo | 128/586 X |
| 2,863,231 | 12/1958 | Jones | 128/615 |
| 2,978,818 | 4/1961 | Baumann | 128/586 |
| 3,244,176 | 4/1966 | Neu | 128/614 X |

*Primary Examiner*—John D. Yasko

*Attorney, Agent, or Firm*—Philip Furgang

[57] ABSTRACT

Disclosed is an orthotic in which the heel portion of a sole is raised above the forefoot-receiving portion by one and one-half inches. The sole is of ordinary shape and dimensions, except that there is disposed upon the sole a rectangular metatarsal pad having one edge extending perpendicularly to the metatarsals and engaging the head of the second metatarsal, the perpendicular sides engaging the medial side of the fifth metatarsal and the lateral side of the first metatarsal. As an addition, a heel spur pad may be secured at the heel-receiving portion of the sole.

In an alternative embodiment, the sole may be provided with marginally laterally upstanding lips of approximately one-half inch in height along the shank, so as to retain and obscure from view a scaphoid pad. These marginal lips may be combined with the metatarsal pad.

It should also be appreciated that the relative height of the heel with regard to the forefoot receiving portions is to remain the same even though a high heel is attached. Thus, the higher the heel, the thicker the sole at the forefoot portion.

The preferred assembly of this orthotic includes a metatarsal pad 16, side lips 48 and 50, heel spur pads 40 and the elevation of the heel-receiving portion 12 with respect to the forefoot-receiving portion 14, as more specifically set forth herein. This combination provides a standard orthotic which is combined in the setting of a standard appearing shoe. The significance of this invention is that not only is this construction intended to relieve a plurality of foot ailments, but it can be beneficially and comfortably worn by those with normal feet. As a result of the general application of this orthotic, many foot ailments may be relieved without the need for specialized treatment by a physician.

34 Claims, 5 Drawing Figures

ORTHOTIC

BACKGROUND OF THE INVENTION

This invention relates to devices used to cure foot ailments and, more particularly, to orthotics employed in shoes.

The human foot may be subject to a number of abnormalities which cause pain. A number of corrective constructions have been devised for curing these problems. These corrective constructions are generally referred to in the art as "orthotics" and may be integrally formed in a shoe or adapted to be received by a shoe. Generally, these constructions are designed to meet the specific needs of a patient. As such, often the orthotic is molded to support the patient's foot and made a part of or secured to a shoe. The result of this specific approach is commonly described as "the space shoe": a large, cumbersome object, ugly in appearance. Thus, it is believed that there has not been until now a single orthotic with a generalized construction capable of relieving a variety of foot ills.

Among the prior art orthotic constructions is one proposed by Fukuoka in U.S. Pat. No. 4,033,054, a sole of a shoe intended to have so-called pressure projections to provide simulated finger pressure projections to provide simulated finger pressure treatment. Each of these so-called finger pressure treatment projections has a magnet therein, thereby providing a nonyieldable projection upon which the foot is intended to rest. The projections disclosed are apparently intended to engage predetermined finger pressure points on a human foot.

Richardson et al., in U.S. Pat. No. 1,778,002, provides an orthotic in which the shank is provided with extensions which are intended to act as an arch support. These shank extensions extend laterally from the shank of the sole, extending outwardly at an acute angle with respect to the sole. The disadvantage of this construction is that it requires a shoe with relatively high sides to protect or hide this orthotic. Furthermore, the wider or higher such lateral extensions are, the more pressure is exerted upon the side or arch, vamp, foxing, and quarter of the shoe, thereby distorting the shoe itself.

It is also well known in the prior art to provide orthotics comprising pads attached to the insole. These may be metatarsal pads, midtarsal pads, or heel spur pads, such as those disclosed by Riehle et al. in U.S. Pat. No. 1,867,679, Frese, Jr. in U.S. Pat. No. 2,959,875, Nalick in U.S. Pat. No. 3,777,419, and Stemmons in U.S. Pat. No. 2,075,552.

However, the disadvantage of all of these prior art devices is believed to be that none is capable of relieving, at one time, a plurality of such problems as hammer toes, bunions, claw toes, Morton's neuroma, metatarsalgia, and the like. Nor is there provided, in combination, a sole construction and scaphoid pad which permits the use of the scaphoid pad in decorative open footwear of a sandal or similar construction.

SUMMARY OF THE INVENTION

It is an object of this invention to provide an orthotic capable of being used for a plurality of foot ailments.

It is an object of this invention to provide a sole construction for relieving a plurality of foot ailments which may be incorporated in a shoe having a generally ordinary appearance.

It is still another object of this invention to provide an orthotic which is economical to manufacture and simple in use and adapted to relieve many different types of foot ailments.

It is an object of this invention to provide an orthotic which may be disposed in a shoe of ordinary appearance and worn by those with or without foot ailments, to thereby eliminate the need for specialized treatment by a physician.

In accordance with the teachings of this invention, there is provided an orthotic construction of the type intended to receive a human foot. The orthotic comprises a sole including heel and forefoot receiving portions, the heel portion being elevated approximately one and one-half inches above the forefoot portion. There is also provided a metatarsal pad secured to the sole and so dimensioned as to have one marginal edge substantially adjacent and proximal to the head of the second metatarsal, a second marginal edge substantially adjacent and lateral to the first metatarsal, and a third marginal edge substantially adjacent and medial to the fifth metatarsal.

In yet another aspect of this invention, there is provided an orthotic construction in which a sole has heel and forefoot receiving portions, the heel portion being elevated above the forefoot receiving portion by approximately one and one-half inches. The shank portion of said sole has upstanding lips to retain therebetween and obscure a scaphoid pad.

A BRIEF DESCRIPTION OF THE DRAWING

DESCRIPTION OF THE PREFERRED EMBODIMENTS

The orthotic of this invention has applicability to a wide variety of foot ailments. As indicated hereinabove, it is believed that there is no one type of orthotic construction which can correct a multiplicity of different ailments with a basic pad construction. As a result, physicians may have to prescribe the bulky so-called "space shoe". The prior art, as described above, shows only that midtarsal and metatarsal pads have been suggested, but no one simple construction specifically directed to accommodating a plurality of foot problems with a basic pad. The subject of this invention is an orthotic which accomplishes this objective and yet looks very much like any ordinary shoe.

Figure 1:
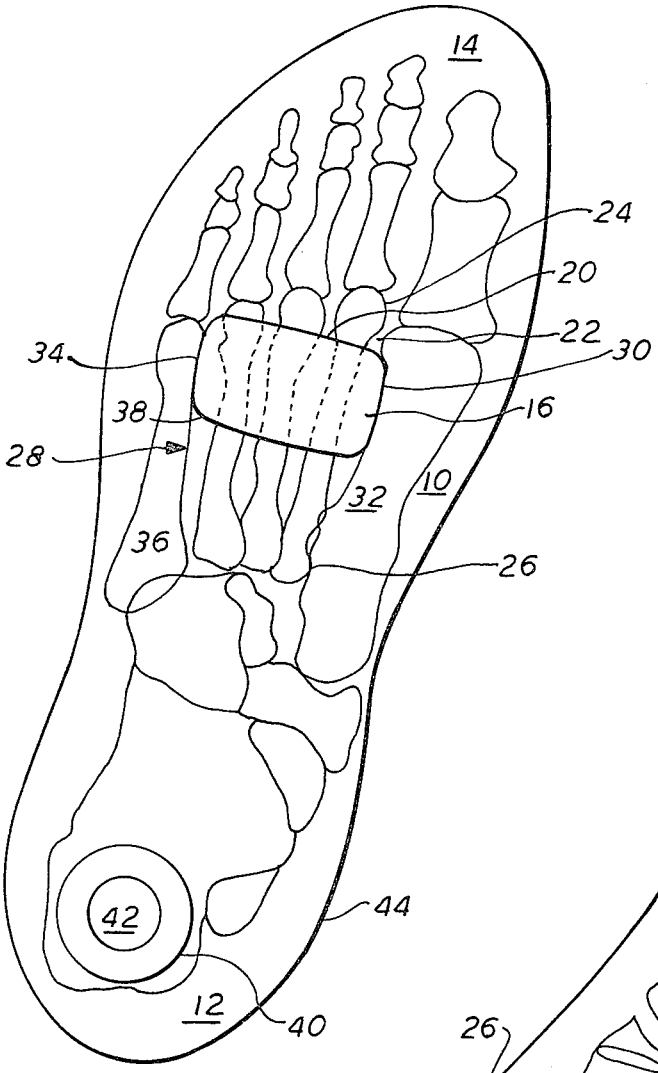
FIG. 1 is a diagrammatic view of an orthotic constructed in accordance with the teachings of this invention, with the skeletal outline of a human foot disposed thereon.
Figure 2:
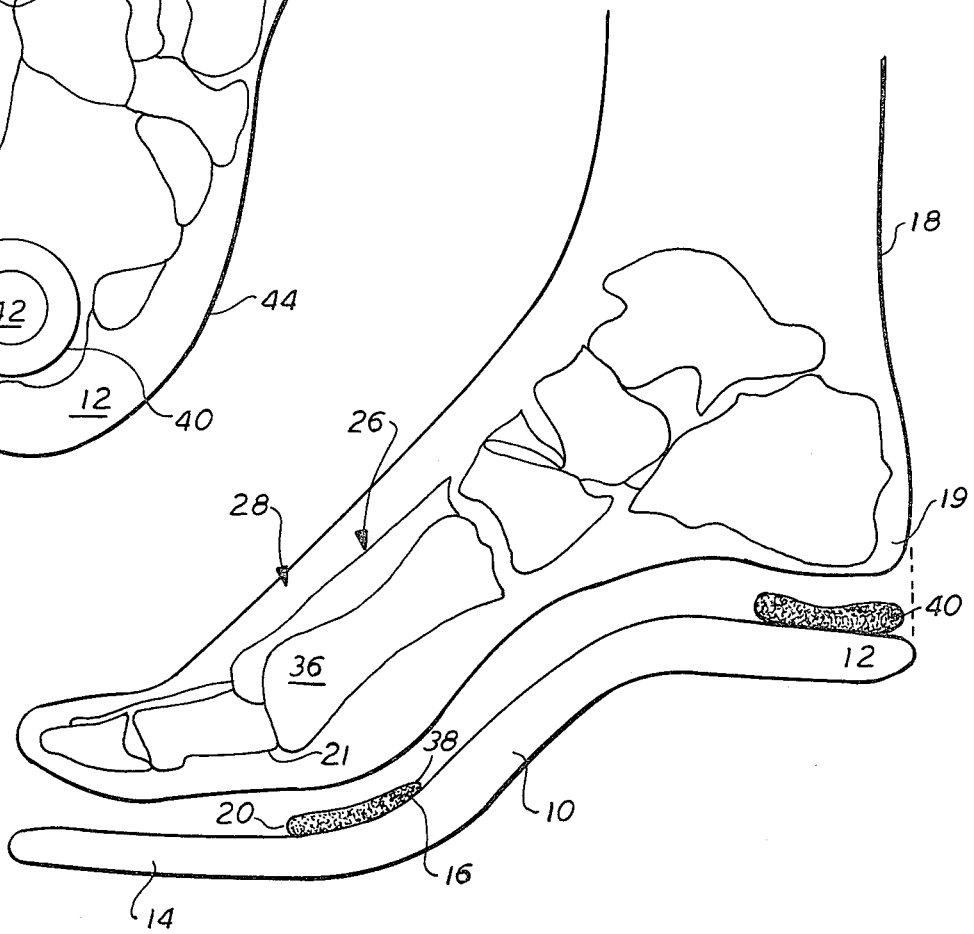
FIG. 2 is a diagrammatic side view of the orthotic of FIG. 1, with a human foot in skeletal formation shown in alignment therewith.

Turning to the drawing, there is provided a sole 10 shown diagrammatically in FIGS. 1 and 2. The sole 10 may be inserted and secured to an insole or formed as part of the insole or as an integral outsole, as is well known in the construction of any shoe. As shown, the sole 10 comprises the heel-receiving portion 12 and the forefoot-receiving portion 14. It will be noted that, as shown, the heel-receiving portion 12 is disposed at a distance of approximately one and one-half inches above the forefoot-receiving portion 14. This significance of relative positioning of the heel with the forefoot will be discussed below.

A metatarsal pad 16 may be secured to the sole 10 at the forefoot-receiving portion 14. The sole 10 may be of any ordinary construction, such as leather, plastic, or the like. In a similar manner, the construction of the metatarsal pad 16 is similar to prior art metatarsal pads, in that it may be made of foam rubber, plastic, or any other similar compressible, yieldable material. The importance of this pad 16, as differentiating it from prior art pads, is both its size and location upon the sole 10. The pad 16 may be formed as an integral part of the sole or a separate pad adhered thereto.

It is essential that the metatarsal pad 16 be located upon the sole 10 in the forefoot-receiving portion 14, so as to come into contact with particular portions of a human foot 18, so that the beneficial effect of the pad 16 may be received. These locations are essential to this invention. Thus, it will be noted that the metatarsal pad 16 has marginal edges which may substantially define a rectangle. It must be disposed upon the sole 10 in such a fashion that one marginal edge 20 may be substantially adjacent and proximal to the head 22 of the second metatarsal 24 of the skeletal structure 26 of the foot 18 disposed upon the sole 10. This marginal edge 20 of the metatarsal pad 16 is substantially perpendicular to the metatarsals 28 of the foot 18. One marginal edge 30, extending perpendicularly from the first marginal edge 20, should be aligned substantially adjacent and lateral to the first metatarsal 32. It will be noted that this second marginal edge 30 may have a slight convexity which generally conforms to the medial concavity of the first metatarsal 32. However, this is believed not to be generally essential. Further, it is necessary that the pad 16 be substantially adjacent to the lateral side of the first metatarsal 32. Direct abutment, however, is not necessary.

The third side 34 of the pad 16, which extends perpendicularly from the first marginal edge, is disposed substantially adjacent and medial to the fifth metatarsal 36. Here, again, it is not essential that the pad 16 directly abut the medial side of the fifth metatarsal 36, but be generally adjacent thereto.

Finally, it is preferred that the fourth marginal edge 38 be substantially parallel to the first marginal edge 20 and be spaced therefrom by approximately one inch toward the heel-receiving portion 12. It has also been found preferable that the pad 16 have a height of approximately $\frac{3}{8}$ of an inch and, upon compression—that is, upon the placing of the foot 18 thereon—compressed to approximately $\frac{1}{4}$ inch in thickness.

It has been found that, contrary to prior construction, the following foot ailments have been beneficially affected by this combination: hammer toes, bunions, claw toes, Morton's neuroma, metatarsalagia. The beneficial effects flow from the raising of a heel 19 above the forefoot 21 of the foot 18 in combination with the pad 16.

The combination of the pad 16 and relative heel height between the heel-receiving portion 12 and the forefoot-receiving portion 14 of the sole 10 may be combined with other rehabilitating shoe supports. Accordingly, it may be possible to add a heel spur pad 40. The heel spur pad 40 may be of an ordinary configuration, well known in the art. Thus, as contemplated, the spur pad 40 may be integrally formed with the sole or separately and attached thereto, as is well known in the art. The pad 40 may be preferably centered upon the heel-receiving portion 14 with the center depression 42 having a diameter approximately the size of an ordinary half dollar. The outer diameter can be of any desired dimension, including extending out to the marginal edges 44 of the shoe itself. Spur pads 40 are well known for their beneficial effect upon certain foot ailments. This spur pad 40 can be added to the corrective orthotic of this invention.

Figure 4:
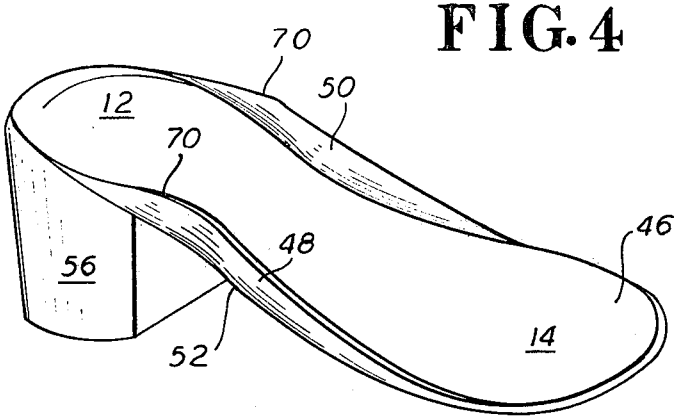
FIG. 4 is a perspective view of an orthotic constructed in accordance with the teachings of this invention.
Figure 3:
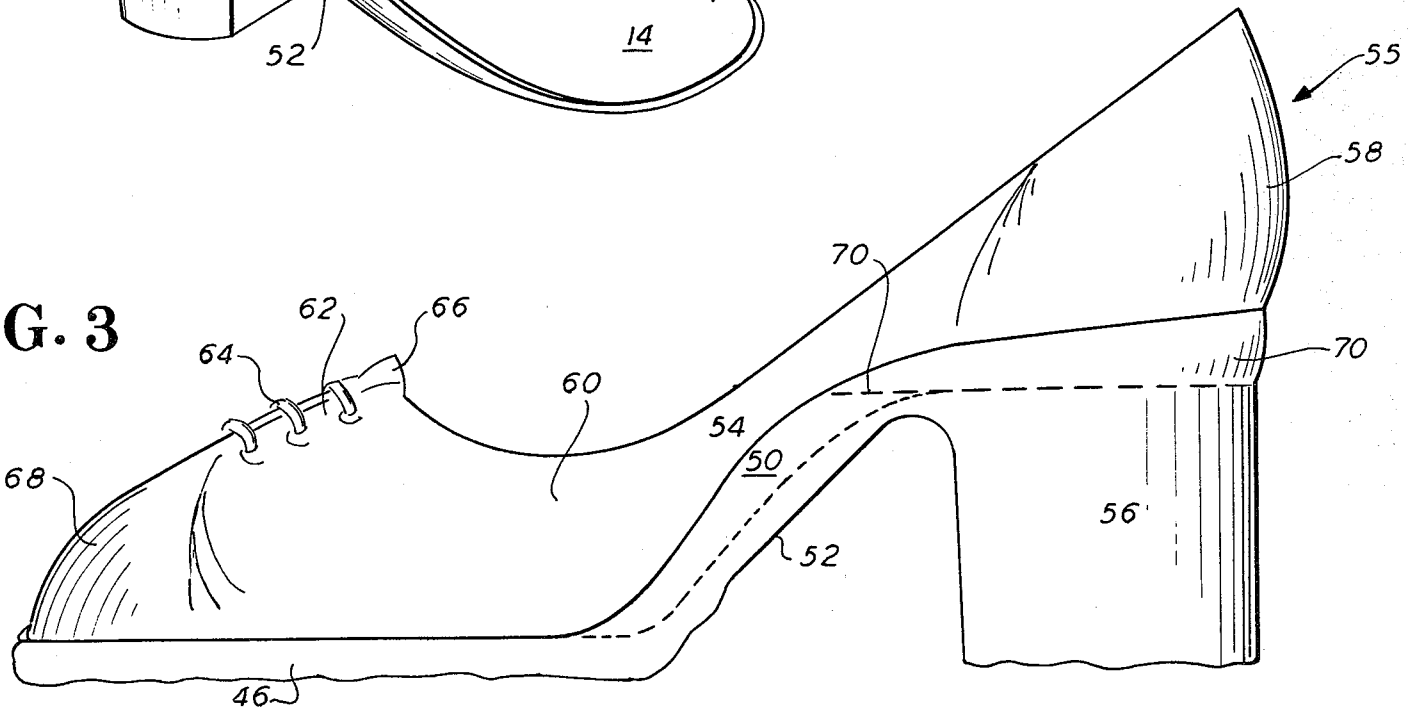
FIG. 3 is a plan view of a shoe constructed in accordance with the teachings of this invention.

Yet another problem involving the use of orthotics is the need for a scaphoid pad (not shown) for supporting and assisting in the reformation of the midtarsal arch. Scaphoid pads are well known. They are used, in general, to be inserted at the location of the midtarsal arch. Unfortunately, such pads generally cause the foot to put pressure on the side or arch of a shoe. If the shoe is low cut, as in men's and women's sandals, or women's high heel shoes, or the like, the scaphoid pad will be visible and unsightly. There are thus presented two problems: the problem of the strength of the arch of the shoe to resist distortion by the effect of the scaphoid pad, as well as the ability of the shoe to hide the scaphoid pad. In order to overcome this, there is provided a sole 46 (FIGS. 3 and 4) having a heel-receiving portion 12 and a forefoot-receiving portion 14. This sole 46 is supplied with upstanding, vertically extending, opposed marginal lips 48 and 50. These lips 48 and 50 are confined to the marginal edge of a shank 52 of the sole 46.

In the context of a shoe 55 (FIG. 3), its arch sides 54 may be secured to the lips 48 and 50. The sole 46, with its upstanding lips 48 and 50, may be secured to a heel 56. A quarter 58 is secured to the heel 56 by means ordinarily known in the art. The quarter 58 may be secured to the arch 54. The arch 54 may be integrally formed with a vamp and throat 60 and 62, respectively. The throat 62 may be furnished with laces 64 and a tongue 66. The vamp 60 may be secured to the sole 46 and to a tip 68, which is, in turn, secured to the sole 46, all in a manner well known in the art.

Obviously, numerous designs may suggest themselves and form no part of this invention. Thus, as shown (FIG. 3), a decorative mud guard 70 covers a portion of the quarter 58 and joins with the marginal side edge 71 of the lips 48 and 50 as they extend from the heel-receiving portion 12, so as to provide a uniform collar extending down to the forefoot 14. However, this is merely a matter of decorative choice.

The lips 48 and 50 are rigid and form an integral part of the sole 46, so as to withstand the outward forces of the foot and, at the same time, hide the scaphoid pad.

It should be understood that the scaphoid pad supporting lips 48 and 50 may be combined with the metatarsal pad 16 described earlier herein. In the alternative, the lips 48 and 50 may be used independently thereof for the user who only requires the scaphoid pad.

Figure 5:
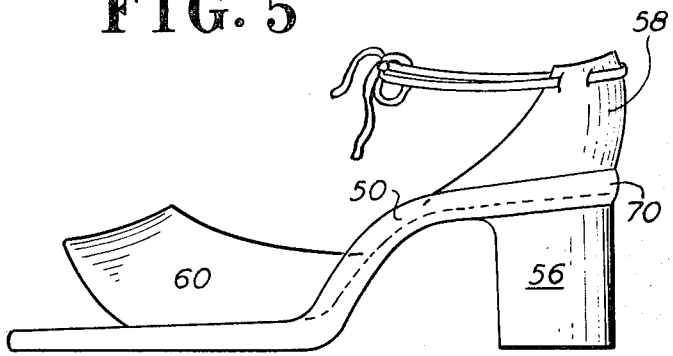
FIG. 5 is a plan view of another shoe constructed in accordance with the teachings of this invention.

It should also be appreciated that the arch 54 might be eliminated from the shoe 55 entirely, thereby giving a free and exposed form usually available in non-scaphoid women's sandals and high heels and in designs of men's loafer shoes, as well (FIG. 5). The lips 48 and 50 may be made of any substantial rigid material, such as that which forms the sole 46, or any other similar material lending strength and support. It is preferred that the lips 48 and 50 extend approximately $\frac{1}{2}$ inch above the lower edge 70 of the sole 46 to which it is attached or forms a part.

It should be appreciated that the length of the first marginal edge 20 of the metatarsal pad 16 will vary with the size of the shoe. Within each size, however, the length of the first marginal edge 20 of the pad 16 will have a fixed size and location.

This construction will, therefore, eliminate the use of a plurality of differently shaped pads or molded shoes. The physician's diagnosis of a foot ailment in the class referred to herein will require the purchase of this standard shoe construction. To this basic construction, the orthotic of this invention may be a separate insole, an insole-outsole combination, or an insole insert. The physician may add a spur pad 40, either in combination with the scaphoid pad 16, or alone. In the alternative, the physician might, if calling for a scaphoid pad, add the marginal lips 48 and 50 either alone or with the metatarsal pad 16 or a heel spur pad 40. In all cases, however, it is essential that the heel portion 12 be at one and one-half inches above the forefoot-receiving portion 14.

Finally, it is preferred that the tip 68, vamp 60, and throat 62 be made of a soft material, rather than stiff, unyielding leather or plastic, to reduce abrasion and prevent the formation of calluses or the like.

What is claimed:

1. An orthotic construction of the type intended to be incorporated in a shoe so as to receive thereon a human foot, said orthotic comprising:

(a) a sole including heel and forefoot receiving portions;

(b) means for elevating said heel receiving portion approximately one and one-half inches above said forefoot receiving portion; and (c) a metatarsal pad secured to said sole and so dimensioned as to have one marginal edge substantially adjacent and proximal to the head of the second metatarsal, a second marginal edge substantially adjacent and lateral to the first metatarsal, and a third marginal edge substantially adjacent and medial to the fifth metatarsal of the foot.

2. An orthotic construction as recited in claim 1 wherein said metatarsal pad has a substantially rectangular shape.

3. An orthotic construction as recited in claim 2 wherein said metatarsal pad's first marginal edge being substantially perpendicular to the metatarsals of the foot.

4. An orthotic construction as recited in claim 3 wherein said metatarsal pad having a fourth margininal edge parallel to said first marginal edge and spaced one inch from said first marginal edge toward said heel receiving portion; said second marginal edge of said pad having a substantially convex curvature so as to complement the convex curvature of the lateral side of the first metatarsal of the foot.

5. An orthotic construction as recited in claim 4 wherein said metatarsal pad being made of a soft, resilient material and having a thickness of approximately $\frac{3}{8}$ inch in noncompression and $\frac{1}{4}$ inch upon compression by the foot.

6. An orthotic construction as recited in claim 5 further comprising a heel spur pad secured to said heel receiving portion of said sole.

7. An orthotic construction as recited in claim 6 wherein the shank comprises integrally formed upstanding lips to retain and obscure therewithin a scaphoid pad.

8. An orthotic as recited in claim 7 wherein said lips are approximately one-half inch in height and of substantially the same thickness as said sole.

9. An orthotic construction as recited in claim 1 further comprising a heel spur pad secured to said heel receiving portion of said sole.

10. An orthotic construction as recited in claim 1 wherein said metatarsal pad's first marginal edge being substantially perpendicular to the metatarsals of the foot.

11. An orthotic construction as recited in claim 10 wherein said metatarsal pad having a fourth marginal edge parallel to said first marginal edge and spaced one inch from said first marginal edge toward said heel receiving portion; said second marginal edge of said pad having a substantially convex curvature so as to complement the convex curvature of the lateral side of the first metatarsal of the foot.

12. An orthotic construction as recited in claim 11 wherein said metatarsal pad being made of a soft, resilient material and having a thickness of approximately $\frac{3}{8}$ inch in noncompression and $\frac{1}{4}$ inch upon compression by the foot.

13. An orthotic construction as recited in claim 11 wherein the shank comprises integrally formed upstanding lips to retain and obscure therewithin a scaphoid pad.

14. An orthotic as recited in claim 13 wherein said lips are approximately one-half inch in height and of substantially the same thickness as said sole.

15. An orthotic construction as recited in claim 11 further comprising a heel spur pad secured to said heel receiving portion of said sole.

16. An orthotic construction as recited in claim 1 wherein said metatarsal pad having a fourth marginal edge parallel to said first marginal edge and spaced one inch from said first marginal edge toward said heel receiving portion; said second marginal edge of said pad having a substantially convex curvature so as to complement the convex curvature of the lateral side of the first metatarsal of the foot.

17. An orthotic construction as recited in claim 16 wherein said metatarsal pad has a substantially rectangular shape.

18. An orthotic construction as recited in claim 17 wherein said metatarsal pad being made of a soft, resilient material and having a thickness of approximately $\frac{3}{8}$ inch in noncompression and $\frac{1}{4}$ inch upon compression by the foot.

19. An orthotic construction as recited in claim 17 wherein the shank comprises integrally formed upstanding lips to retain and obscure therewithin a scaphoid pad.

20. An orthotic as recited in claim 19 wherein said lips are approximately one-half inch in height and of substantially the same thickness as said sole.

21. An orthotic construction as recited in claim 17 further comprising a heel spur pad secured to said heel receiving portion of said sole.

22. An orthotic construction as recited in claim 1 wherein the shank comprises integrally formed upstanding lips to retain and obscure therewithin a scaphoid pad.

23. An orthotic as recited in claim 22 wherein said lips are approximately one-half inch in height and of substantially the same thickness as said sole.

24. An orthotic construction as recited in claim 5 wherein the shank comprises integrally formed upstanding lips to retain and obscure therewithin a scaphoid pad.

25. An orthotic as recited in claim 24 wherein said lips are approximately one-half inch in height and of substantially the same thickness as said sole.

26. An orthotic as recited in claim 1 wherein said elevating means comprises a heel secured to said heel-receiving portion to thereby raise said heel said one and one-half inches above said forefoot-receiving portion.

27. An orthotic as recited in claim 5 wherein said elevating means comprises a heel secured to said heel-receiving portion to thereby raise said heel said one and one-half inches above said forefoot-receiving portion.

28. An orthotic as recited in claim 15 wherein said elevating means comprises a heel secured to said heel-receiving portion to thereby raise said heel said one and one-half inches above said forefoot-receiving portion.

29. An orthotic construction of the type secured within a shoe and intended to receive a scaphoid pad and support a human foot, said orthotic comprising:

(a) a sole including heel and forefoot receiving portions;

(b) means for elevating said heel-receiving portion approximately one and one-half inches above said forefoot-receiving portion; and (c) a shank portion comprising integrally formed upstanding lips to retain therebetween and obscure a scaphoid pad.

30. An orthotic construction as recited in claim 29 further comprising a heel spur pad secured to said heel receiving portion of said sole.

31. An orthotic construction as recited in claim 29 wherein said lips are approximately one-half inch in height and of substantially the same thickness as said sole.

32. An orthotic construction as recited in claim 31 further comprising a heel spur pad secured to said heel-receiving portion of said sole.

33. An orthotic as recited in claim 29 wherein said elevating means comprises a heel secured to said heel-receiving portion to thereby raise said heel said one and one-half inches above said forefoot-receiving portion.

34. An orthotic as recited in claim 32 wherein said elevating means comprises a heel secured to said heel-receiving portion to thereby raise said heel said one and one-half inches above said forefoot-receiving portion.

* * * * *